US007789591B2

(12) United States Patent
Häkkinen et al.

(10) Patent No.: US 7,789,591 B2
(45) Date of Patent: Sep. 7, 2010

(54) METHOD AND ARRANGEMENT FOR IMPROVING SOIL AND/OR FOR LIFTING STRUCTURES

(75) Inventors: Sami Häkkinen, Tampere (FI); Tuomas Lievonen, Nokia (FI)

(73) Assignee: Uretek Worldwide Oy, Tampere (FI)

( * ) Notice: Subject to any disclaimer, the term of this patent is extended or adjusted under 35 U.S.C. 154(b) by 0 days.

(21) Appl. No.: 12/301,586

(22) PCT Filed: Jun. 4, 2007

(86) PCT No.: PCT/FI2007/050321

§ 371 (c)(1),
(2), (4) Date: Nov. 19, 2008

(87) PCT Pub. No.: WO2007/141384

PCT Pub. Date: Dec. 13, 2007

(65) Prior Publication Data

US 2009/0155002 A1 Jun. 18, 2009

(30) Foreign Application Priority Data

Jun. 5, 2006 (FI) ..... 20065379

(51) Int. Cl.
*E02D 3/12* (2006.01)

(52) U.S. Cl. ..... 405/267; 405/263; 405/269; 405/302.4

(58) Field of Classification Search ..... 405/263, 405/264, 265, 266, 267, 268, 269, 270, 302.4
See application file for complete search history.

(56) References Cited

U.S. PATENT DOCUMENTS

RE25,614 E 7/1964 Turzillo
6,354,768 B1 3/2002 Fox
6,634,831 B2 * 10/2003 Canteri ..... 405/264
2002/0098042 A1 * 7/2002 Canteri ..... 405/40
2005/0158128 A1 * 7/2005 Canteri ..... 405/266

FOREIGN PATENT DOCUMENTS

EP 0851064 7/1998
EP 1314824 5/2003

(Continued)

OTHER PUBLICATIONS

PCT International Search Report, PCT/FI2007/050321, National Board of Patents and Registration of Finland, Sep. 26, 2007.

(Continued)

*Primary Examiner*—Frederick L Lagman
(74) *Attorney, Agent, or Firm*—Andrus, Sceales, Starke & Sawall, LLP

(57) ABSTRACT

A hole (6) is provided in soil or a structure, and an injection bar (1) having a fillable expansion element (2) in connection therewith is arranged into the hole. A substance which expands as a consequence of a chemical reaction is injected into the expansion element (2). The expansion element (2) filled with the reacted substance condenses, fills or replaces surrounding soil or lifts as well as stabilizes ground-based structures. A force pressing the expansion element (2) against the soil is generated by the chemical reaction which expands the substance injected into the expansion element (2).

27 Claims, 4 Drawing Sheets

FOREIGN PATENT DOCUMENTS

| | | | | |
|---|---|---|---|---|
| JP | 59048518 | A | * | 3/1984 |
| JP | 59130910 | | | 7/1984 |
| JP | 03087412 | A | * | 4/1991 |
| JP | 06010336 | A | * | 1/1994 |
| JP | 7018651 | | | 1/1995 |
| JP | 9158235 | | | 6/1997 |
| JP | 10195860 | | | 7/1998 |
| JP | 2003105745 | | | 4/2003 |
| JP | 2006028946 | | | 2/2006 |

OTHER PUBLICATIONS

Finnish Official Action, 20065379, National Board of Patents and Registration of Finland, May 10, 2007.

* cited by examiner

METHOD AND ARRANGEMENT FOR IMPROVING SOIL AND/OR FOR LIFTING STRUCTURES

CROSS REFERENCE TO RELATED APPLICATION

The present application is the U.S. national stage application of International Application PCT/FI2007/050321, filed Jun. 4, 2007, which international application was published on Dec. 13, 2007 as International Publication WO 2007/141384. The International Application claims priority of Finnish Patent Application 20065379, filed Jun. 5, 2006.

BACKGROUND OF THE INVENTION

The invention relates to a method for improving soil and/or for lifting ground-based structures, the method comprising providing the soil or structure with a hole, arranging into the hole an injection bar and an expansion element provided in connection therewith, and injecting a substance into the expansion element.

The invention further relates to an arrangement for improving soil and/or for lifting structures, the arrangement comprising an injection bar to be arranged into a hole and provided in connection with an expansion element, a substance to be injected into the expansion element, and means for injecting the substance into the expansion element.

Soil is improved e.g. in order to increase the bearing capacity thereof or in order to fill empty spaces therein. Further, soil improvement is necessary if vibrations transmitted via the soil are to be dampened or soil liquefaction taking place in connection with earthquakes is to be prevented. A process of lifting structures, in turn, refers e.g. to lifting and stabilizing buildings or foundations for buildings or floors that are damaged, subsided or dislocated. Furthermore, the process of lifting structures comprises lifting and stabilizing subsided paved roads or fields, such as concrete and asphalt roads or runways.

Deterioration of soil or subsidence of structures may be caused e.g. by poorly consolidated soil, water-induced erosion, inappropriate soil type during construction, deterioration of frictional forces in the soil, or variations in temperature or humidity conditions. Further, soil deterioration may be caused by changes in conditions due to mechanical damage, such as breakage of water or sewer pipes. Moreover, soil conditions may change due to the influence of dynamic forces.

In order to improve the soil, soil having a poor bearing capacity is replaced by a substance having a better bearing capacity. Such a process called mass exchange is extremely laborious and expensive. Further, piling techniques, such as friction piles which, through friction, are supported by the soil, or base piles which rest on the hard bottom layer, are used. Piling requires heavy and complex equipment, which subjects the environment to noise and further disturbance. Since the piling is fastened to a structure, it subjects the structure to point loads when the structure is supported by piles, and not by the soil.

EP 0 851 064 discloses a solution for improving the bearing capacity of soil. In the solution, the soil is provided with holes into which a substance which expands as a consequence of a chemical reaction is injected. EP 1 314 824 discloses a similar solution wherein a substance is used for producing a pressure of more than 500 kPa. In practice, it has been noticed that in these solutions, the only way to determine a dose to be injected is to monitor the surface of the ground or the height level of a building, and stop injecting when a reaction in these aspects is observed. When these solutions are used in connection with porous and soft soils in particular, the procedures of dosing the substance to be injected appropriately and directing the expansion force correctly as well as keeping the substance in a desired place present very challenging tasks.

JP 7 018 651 discloses a solution wherein expanding bag bodies are arranged into holes drilled into the soil. A hardening agent is pumped into the bags with a high pressure. Due to the usage of a high hydraulic pressure, the devices used are complex and, for example, valves that are failure-sensitive in difficult conditions are required. Furthermore, in soft soil, it is uncertain that the bag stays in place, so it is very difficult to condense a portion of soft soil by means of this solution. Still further, if a bag is broken, the condensing process gets totally out of control. JP 10 195 860 discloses a similar solution wherein a flexible bag is used. This solution also suffers from problems similar to those disclosed above. JP 2003 105 745 discloses a solution wherein plastic mortar is injected into soil or into a bag arranged in the soil. The above-disclosed problems are present also in this solution when a substance is injected into a bag.

JP 9 158 235 discloses a solution for correcting inclination of a building. The solution comprises drilling a hole which extends under the foundations of the building. Here, under the foundations, a flexible bag is arranged into which water and a consolidating substance are conveyed through separate pipes. The aim is to lift the building through filling the bag. This solution also requires the usage of an extremely high hydraulic pressure, resulting in complex and failure-sensitive equipment. The equipment also includes a plurality of pipes, which adds to its complexity. Furthermore, if a bag is broken while in use, the structure may collapse at the particular bag, so the method is extremely risky.

BRIEF DESCRIPTION OF THE INVENTION

An object of the present invention is to provide a novel method and arrangement for improving soil and/or for lifting structures.

The method of the invention is characterized by using, for such injecting, a substance which expands as a consequence of a chemical reaction, so that a force pressing the expansion element against the soil is generated mainly by the chemical reaction.

Furthermore, the arrangement of the invention is characterized in that the substance to be injected into the expansion element is a substance which expands as a consequence of a chemical reaction, so that a force pressing the expansion element against the soil is generated mainly by the chemical reaction.

An idea of the invention is that a hole is formed into the soil or structure, and an injection bar accompanied by a fillable expansion element is arranged into the hole. A substance which expands as a consequence of a chemical reaction is injected into the expansion element. The expansion element filled with the reacted substance condenses, fills or replaces surrounding soil or lifts as well as stabilizes ground-based structures. A force pressing the expansion element against the soil is generated by the chemical reaction, which expands the substance injected into the expansion element. The substance also hardens very quickly, so no valves to keep the substance within the expansion element are necessary in the solution. The expansion element enables the expanding substance to be placed in a controlled manner at a desired point. Thus, the localization of expansion pressure is completely controlled. Also e.g. in loose soil, the substance may be provided with a high compression strength. The injection bar can be arranged into a very small hole, so no extensive excavations are necessary. Since the substance hardens very quickly, no substantial extensive and uncontrolled movements of the substance occur should the expansion element be broken. Further, when used for lifting structures, breakage of the expansion element does not substantially damage the strength of the foundations of a building. All in all, the machines and devices to be used in the solution are quite small and simple and, what is more, the solution is excellent as far as work safety is concerned.

An idea of an embodiment is that the injection bar is left in its place in the soil to anchor the expansion element and the substance expanded therein in place. This ensures that the expansion element stays at a desired point also in soft soil.

An idea of a second embodiment is that the injection bar is arranged to penetrate through the expansion element and, on its sides, the injection bar is provided with openings for the substance to be injected into the expansion element so as to allow the substance to enter the expansion element. Such a solution is simple, functional, and effective.

An idea of a third embodiment is that the expansion element is substantially impermeable to air such that the expansion element is provided with an airtight expansion space therein to enable the expansion reaction to be implemented in a controlled manner.

BRIEF DESCRIPTION OF THE DRAWINGS

The invention is described in closer detail in the accompanying drawings, in which FIG. 1 schematically shows a cross-sectional side view of an injection bar and an expansion element, FIG. 2 schematically shows the bar and the expansion element according to FIG. 1 arranged in place and with an injection substance having already reacted, FIG. 3 schematically shows a way of improving the bearing capacity of soil, FIG. 4*a* schematically shows a cross-sectional side view of a second injection bar and expansion element.

For the sake of clarity, the figures show some embodiments of the invention in a simplified manner. In the figures, like reference numerals identify like elements.

DETAILED DESCRIPTION OF SOME EMBODIMENTS OF THE INVENTION

Figure 1:
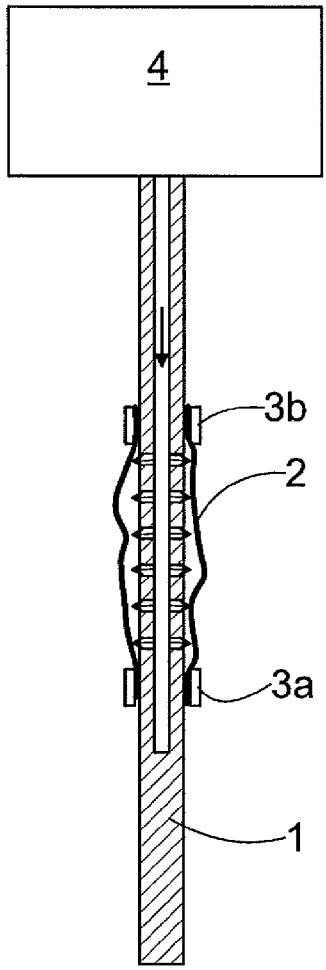

FIG. 1 shows an injection rod or injection bar 1. In the embodiment shown in FIG. 1, an upper end of the injection bar 1 is hollow while a lower end thereof is closed. The outer diameter of the injection bar 1 may vary e.g. between 3 and 200 mm. The length of the injection bar 1 may vary e.g. between 0.5 and 100 m. The injection bar 1 may be made e.g. of metal, such as steel.

The injection bar 1 may also be made of another material, such as plastics, e.g. polyethylene PE. Further, the injection bar 1 does not necessarily have to be stiff. The injection bar 1 may thus be e.g. a hose or a pipe made of plastics.

A fillable expansion element 2 is arranged around the injection bar 1. The expansion element 2 is preferably manufactured from a material which is impermeable to air and substantially inextensible. An example of such a material is geotextile. Further, another flexible and strong material may be used.

The expansion element may be made of plastic, such as polyester or polypropylene or artificial or natural fibre. It may also be made of rubber or another elastomer. A wall of the expansion element may be permeable or impermeable to air. The wall of the expansion element 2 may also be flexible or inflexible. The wall of the expansion element 2 may also be provided with metal reinforcement material or glass fibre or another suitable reinforcement. The expansion element may be either seamless or with seams. A seam may be provided e.g. by sewing, gluing, using a fastening element, riveting, welding, soldering, fusing or by another mechanical, chemical, thermal or electrical method or a combination thereof.

The thickness of a wall of the expansion element 2 may vary e.g. between 0.02 and 5 mm, depending on the material, size of the expansion element 2, expansion pressure, etc. The injection bar 1 is preferably arranged through the expansion element 2 so that the expansion element 2 is fastened to the injection bar 1 e.g. in the manner shown in FIG. 1 by means of a lower fastener 3*a* and an upper fastener 3*b*. Prior to arranging the injection bar 1 into the soil, the expansion element 2 is wound or folded against the injection bar 1. When the expansion element 2 is completely filled up with a solid substance, its outer diameter may vary e.g. between 20 cm and 5 m. Similarly, the length of the expansion element 2, i.e. the distance between the lower fastener 3*a* and the upper fastener 3*b*, may vary e.g. between 20 cm and 100 m.

The expansion element 2 may be e.g. of the shape of a cylindrical sleeve. Furthermore, the upper and lower ends of expansion element 2 may be narrower while the diameter of the middle part thereof may be larger. The external appearance of the expansion element 2 prior to being injected with a substance is irrelevant. After the substance has reacted inside the expansion element, the expansion element reaches its final appearance.

The lower fastener 3*a* and the upper fastener 3*b* may be e.g. hose clamps. Further, the fasteners may be e.g. metal sleeves provided by cutting off a piece of pipe. A metal sleeve may be fastened in place by means of pressing.

The lower fastener 3*a* or the upper fastener 3*b* or both may also be made movable, in which case when the expansion element 2 is being filled, they slide into a suitable place. In comparison with stationary fasteners, this solution has an advantage which enables distortion and consequently even breakage of the injection bar to be avoided. For instance, the lower fastener may be made movable by providing a lower end of the injection bar with a solid bar and arranging a movable sleeve thereon. A wall of the expansion element is arranged on the movable sleeve and a fastening sleeve is arranged around it, the wall of the expansion element thus residing fixedly between the fastening sleeve and the movable sleeve. When the movable sleeve is thus allowed to slide along the surface of the bar, the fastener moves as the expansion element is being filled up.

FIG. 1 further schematically shows an injection apparatus 4, which includes containers wherein a substance to be injected into the expansion element 2 is stored, and means for conveying the substance from such a container into the hollow upper part of the injection bar 1. The structure of the means may be very simple and light, since they do not have to generate any pressure to expand the expansion element 2 in the soil. The means generate pressure to enable the substance to be injected to be conveyed to the expansion element through hoses and pipes, but they do not generate the actual expansion pressure but the expansion pressure is generated inside the expansion element 2 chemically. The injection apparatus 4 is not discussed in detail herein since its structure and operation are clear to those skilled in the art.

The injectable substance flows as shown by the arrows in FIG. 1, through the hollow upper end of the injection bar 1 and via openings 5 provided in the side of the injection bar 1 into the expansion element 2. A chemical reaction takes place in the expansion element 2 such that the substance expands inside the expansion element 2.

The injection bar may also consist of an outer rigid pipe and a hose or pipe arranged thereinside. The inner pipe is movable back and forth inside the outer pipe and, when necessary, also rotatable. The substance to be injected flows through the inner pipe and exits at its lower end and further through openings provided in a side of the outer pipe to the expansion element. While the expansion element is being filled up, the inner pipe is being pulled out of the inside of the pipe. Consequently, when the expansion element is being filled, the substance to be injected flows into the expansion element from a point located closer and closer to an end of the injection bar facing the injection apparatus. The inner pipe may be pulled out of the outer pipe continuously and uniformly or stepwise. Furthermore, such a solution enables a desired spot in the expansion element to be provided with the substance to be injected. For instance, the inner pipe may quite extensively be pulled out of the outer pipe and a substance may be injected into an upper part of the expansion element and a reaction and solidification of the substance may be awaited and, subsequently, the inner pipe may be pushed back inside and inject the substance lower into the expansion element. Such a solution enables the expansion element to be expanded also e.g. at a place which contains a locally dense soil.

Figure 2:
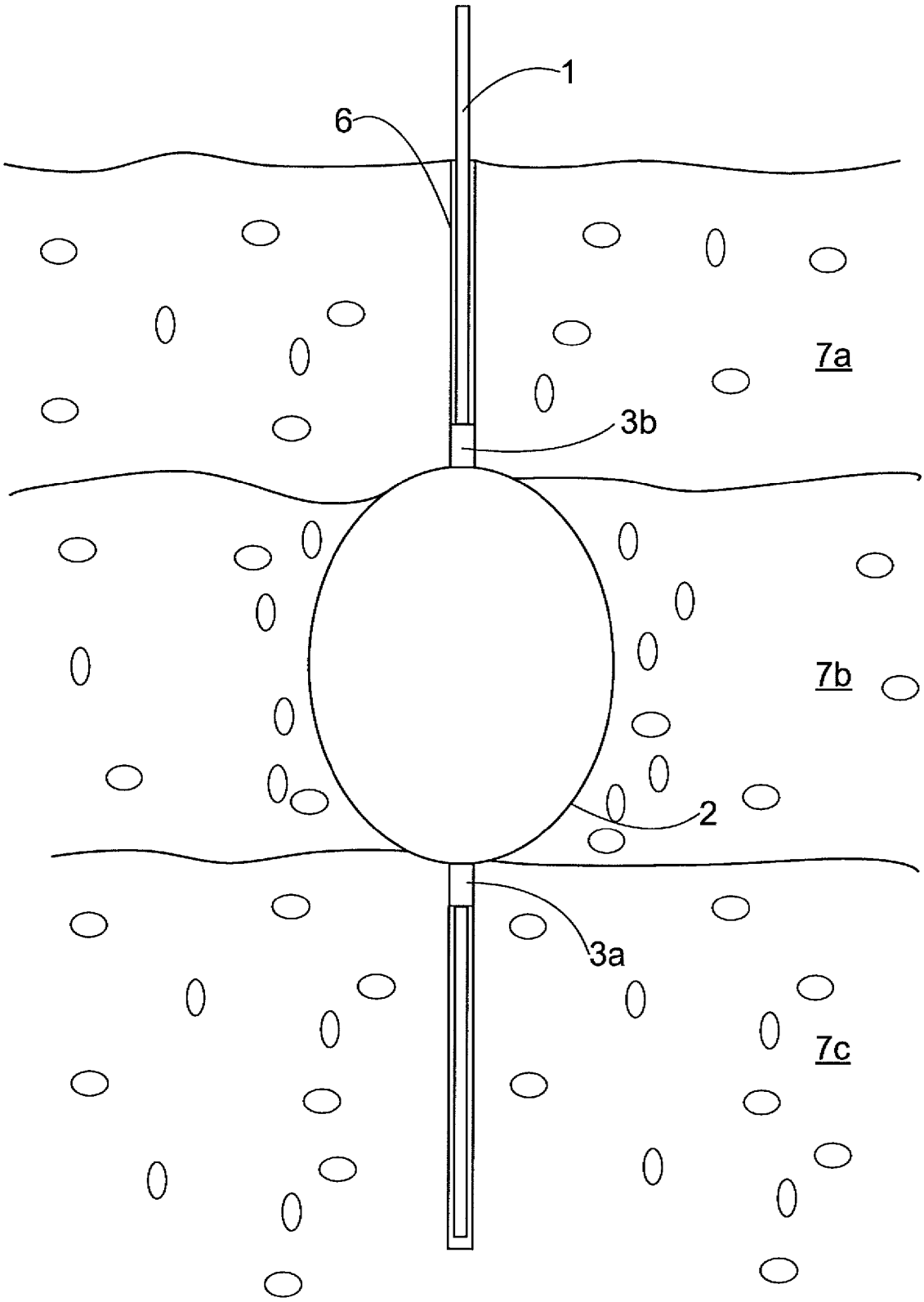

FIG. 2 shows a situation wherein the injection bar 1 has been arranged in the soil and the substance inside the expansion element 2 has already reacted, expanding the expansion element 2.

First, the bearing capacity of the soil and other necessary soil conditions are measured using an appropriate method. The bearing capacity of the soil may be measured by means of e.g. a penetrometer, or another geological or geotechnical examination method. The measurements and examinations enable calculations relating to the soil to be made. On the basis of the measurements, examinations and calculations, the points to be processed may be located in the soil. Such localization of a site to be processed depends on the soil conditions. The aim is to achieve a clear picture of the soil vertically, horizontally as well as laterally in order to process the soil accurately. On the basis of the result obtained, an injection bar 1 is manufactured and an expansion element 2 is fastened thereto. The height and volume of the expansion element 2 and the number of the expansion elements 2 are selected on the basis of the soil conditions. When the solution is used for lifting structures, the size of the expansion element is also naturally affected by the size, weight and lifting need of the structure being processed. A hole 6 is drilled into the soil. The injection bar 1 equipped with the expansion element 2 is arranged in the hole 6. An expanding substance is injected into the expansion element 2. The expanding material may be e.g. a polymer, expanding resin or an organically incrystallizable, chemically expanding multicomponent substance.

The expanding substance may be e.g. a mixture mainly containing two components. In such a case, a first component may mainly contain e.g. polyetherpolyol and/or polyesterpolyol. A second component may contain e.g. isocyanate. The volumetric ratios of the first and the second components may vary e.g. between 0.8 to 1.2:0.8 to 1.8. The expanding substance may also contain catalysts and water and, when desired, also other components, such as silica, stone dust, fibre reinforcements and other possible additives and/or auxiliaries and/or fillers.

The injectable substance is preferably a substance which starts to react by expanding within 0.5 to 3600 seconds after having been injected into the expansion element 2. In an embodiment, the substance starts to react after more than 20 or more than 25 seconds since the injection, whereby the expansion element 2 is filled up evenly, and with a very small risk of breakage. Furthermore, in an embodiment, the substance starts to react after less than 50 seconds after the injection, which makes the process easy to manage.

The substance expands e.g. 1 to 120 times its original volume. The expansion factor of the substance, i.e. the volume of the substance at the end of the reaction as compared with the volume of the substance at the beginning of the reaction, may be e.g. of the order of 1.1 to 120. Preferably, the substance is arranged to expand 1.5 to 20 times its original volume.

The expanding material condenses, fills or replaces surrounding soil, depending on the type or density of the surrounding soil. The replacement takes place by pushing the existing soil aside. The soil may be compressible or incompressible. The final result obtained may be measured using a soil measurement method. In this case, too, e.g. a penetrometer or another geotechnical measuring device may be used for carrying out the measurements.

Preferably, the substance reaches a very high compression strength very quickly. The length of the time during which the substance reaches a high compression strength depends on many different features, such as the amount of the substance, volume of the expansion element, reaction rate of the substance, prevalent temperature conditions, surrounding soil, and the load the soil is subjected to. The substance may reach e.g. 80 to 90% of its final compression strength within about 10 to 15 minutes. Then, e.g. in connection with lifting structures, the expanding substance is capable of receiving loads, and no serious adverse effects are caused even if the expansion element 2 is broken. The amount of the substance to be injected into the expansion element 2 depends on the volume of the expansion element 2 as well as on the determined bearing capacity of the soil and, further, on the desired effect. The procedure of determining the amount of the substance requires an expansion profile for the injectable substance, i.e. data about how much the substance expands, how long it takes, and the amount of force it causes. Thus, the amount is affected by the expansion profile. Next, the way in which it is utilized with respect to the space available, i.e. the volume of the expansion element 2, is determined. In a lifting situation, for example, it is not always necessary to fill the expansion element 2 to the maximum.

The final compression strength of the substance may be determined in a controlled manner prior to injecting. In such a case, the final compression strength of the substance is thus determined in advance, i.e. prior to injecting, on the basis of the resistance of the soil and the space available, i.e. the volume of the expansion element 2.

The pressure produced by the substance being used, i.e. the force per surface area, may vary e.g. between 1 millibar and 800 bar. The compression strength of the substance may vary e.g. between 1 millibar and 3000 bar. The final density of the substance may vary e.g. between 10 to 1200 $kg/m^3$.

The expansion element 2 may thus be e.g. a cylindrical sleeve or another similar structure defined by a wall made of a flexible material. The injection bar 1 does not necessarily have to penetrate through the expansion element 2 but the expansion element 2 may be fastened e.g. to an end of the injection bar 1. In such a case, the expansion element 2 may be e.g. a bag or a sack, and fastened to the injection bar 1 at its one point only such that the substance flows through the hollow injection bar 1, from its end, to the expansion element 2.

If the soil is suitably soft and the injection bar 1 is sufficiently stiff, a hole 6 may be provided by pushing the injection bar 1 into the soil. In such a case, the procedures of providing a hole and arranging the injection bar 1 into the hole thus take place simultaneously. Furthermore, prior to pushing the injection bar 1 into the soil, a hole with a diameter smaller than the outer diameter of the injection bar may be provided therefor. Most typically, however, a hole with a diameter slightly larger than the outer diameter of the injection bar 1 is drilled for the injection bar 1. In such a case, the hole 6 also easily accommodates an expansion element 2 folded around the injection bar.

In order to reduce the size of a hole required by the expansion element 2, the expansion element is preferably provided with an outer diameter which is as small as possible. The expansion element is folded on the outside of the injection bar 1 and preferably reduced in size e.g. by a press so as to lie as tightly as possible against the injection bar 1. The outer diameter of the expansion element may also be reduced utilizing heat, pressurized air, moisture, suction and/or pressure e.g. by roll-calendering. It may be further ensured that the expansion element 2 stays tightly against the injection bar 1 by arranging a plastic film on top of the element. The plastic film may be arranged on top of the expansion element 2 e.g. by sliding or winding.

It is possible to let the plastic film to remain on the expansion element 2 such that the material to be injected is injected inside the plastic film. This provides the feature that the injected material must have a compression strength high enough before it tears the film and expands the expansion element. The film can be provided with a tearing line, such as a perforation, whereby the tearing force needed can be determined accurately. Further the tearing force can be formed to be different at different parts of the film. Using the film on the expansion element 2 together with an injection bar comprising an outer pipe and an inner pipe provides the possibility to expand the expansion element 2 at a desired spot.

Soil examination may reveal that a cavity exists in the soil that should be filled. The injection bar 1 is very easy to arrange in the cavity, e.g. the injection bar 1 according to FIG. 1, such that it penetrates through the cavity. The expansion element 2 then sets at the particular cavity. The expanding substance inside the expansion element 2 fills the cavity and the expansion element 2 prevents the expanding substance from creeping out of the cavity.

If desired, the procedure may include removing the injection bar 1 from the soil, so that only the expansion element 2 remains to fill the desired spot. The injection bar 1 may, however, also be left in its place to anchor the expansion element 2 and the substance therein tightly in place.

FIG. 2 shows a situation wherein a soil layer 7*b* having a lower bearing capacity resides between an upper bearing soil layer 7*a* and a lower bearing soil layer 7*c*. The expansion element 2 is dimensioned to fill the soil layer 7*b* having the lower bearing capacity. The upper and lower ends of the injection bar 1, in turn, become tightly anchored in the bearing soil layers 7*a* and 7*c*. In such a case, the expansion element 2 and the substance therein stay in place, even if the soil layer having the lower bearing capacity were extremely soft.

Figure 3:
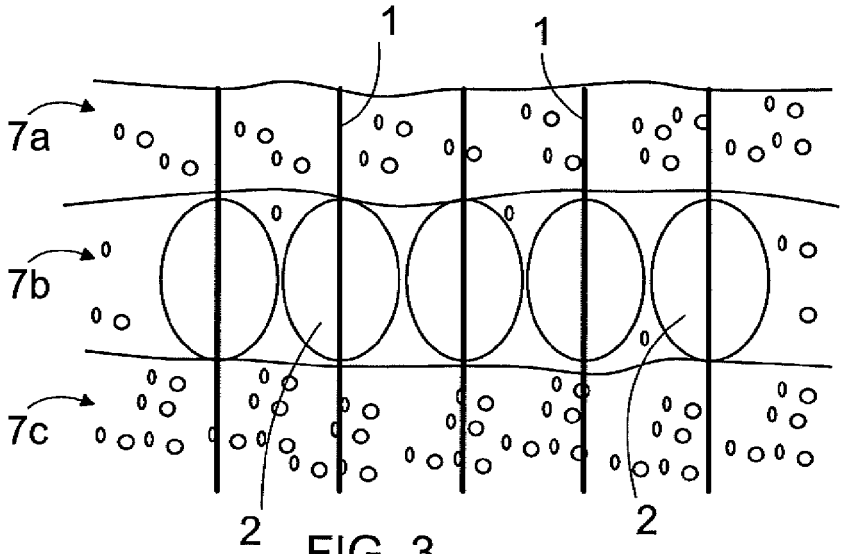

FIG. 3 schematically shows how it is possible to improve a soil layer 7*b* having a lower bearing capacity. A plurality of injection bars 1 equipped with an expansion element 2 has been arranged side by side. If necessary, a plurality of expansion elements 2 may also be arranged on top of one another, either by using one injection bar 1 per a plurality of expansion elements or by using in connection with each expansion element 2 an injection bar 1 of its own. In this manner, the expansion elements 2 containing the reacted substance may be used for supporting the upper soil layer 7*a*. This enables the bearing capacity of the soil to be improved extensively. The soil layer 7*b* having the lower bearing capacity is not necessarily condensed, but the solution of FIG. 3, for example, enables the total bearing capacity to be improved in any case.

In the accompanying drawings, the injection bar 1 is shown to be accompanied by one expansion element 2 but, if desired, two or more expansion elements 2 may be arranged in connection with one injection bar 1 to be filled with an expanding substance.

Figure 4A:
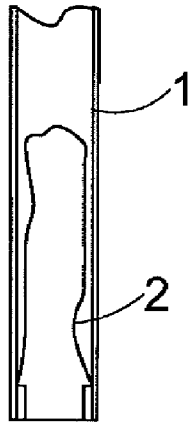
FIG. 4*b* shows the solution of FIG. 4*a* with the expansion element filled up, FIG. 5 schematically shows a cross-sectional side view of an injection bar and an expansion element arranged inside a protective pipe, FIG. 6 schematically shows injection bars and expansion elements arranged in connection with a larger pipe, FIG. 7 schematically shows, in the manner of FIG. 6, injection bars and expansion elements arranged in connection with a larger pipe, and FIG. 8 schematically shows how a structure is lifted.
Figure 4B:
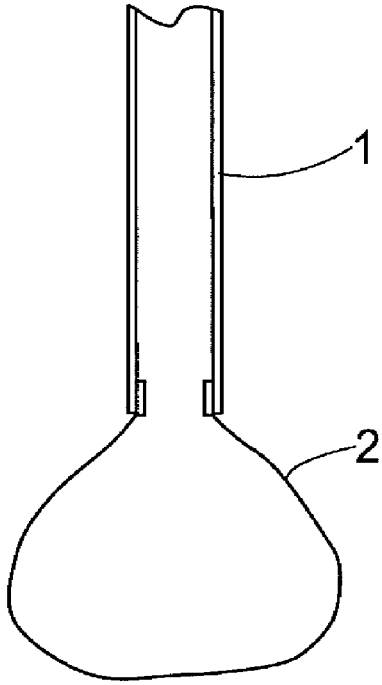

As shown in FIG. 4*a*, the expansion element 2 does not necessarily have to be arranged outside the injection bar 1. If the inner diameter of the injection bar 1 is sufficient, e.g. at least 50 mm, the expansion element 2 may be folded inside the injection bar 1. In such cases, the expansion element 2 may be e.g. a bag or a sack which at its mouth part is fastened to the lower end of the injection bar 1. When a substance is then injected into the expansion element 2, the substance pushes the expansion element 2 out of the injection bar 1, as shown in FIG. 4*b*.

Figure 5:
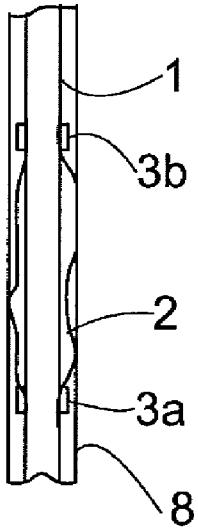

As shown in FIG. 5, a protective pipe 8 may be arranged outside the injection bar 1 and the expansion element 2. The injection bar 1 and the expansion element 2 are forced into the soil by means of the protective pipe 8. The protective pipe 8 is pulled out before injecting the substance into the expansion element 2.

Figure 6:
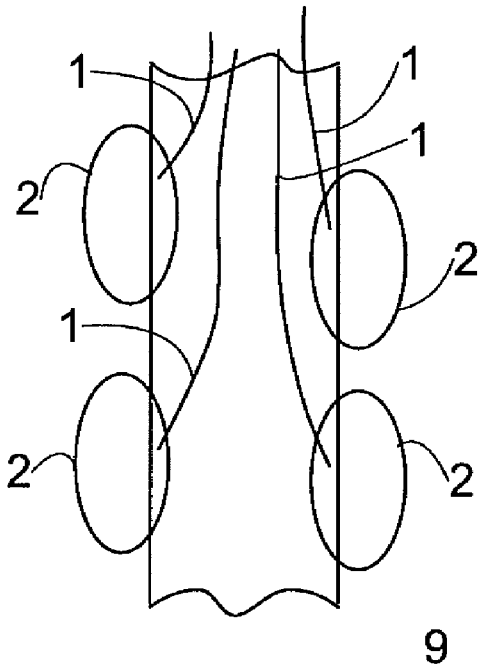

FIG. 6 shows a structure wherein a plurality of expansion elements 2 are arranged on the walls of a pipe 9 having a larger diameter. Hoses for injecting a substance into the expansion elements 2 serve as injection bars 1. The hoses may be arranged inside the pipe 9 having a larger diameter.

Figure 7:
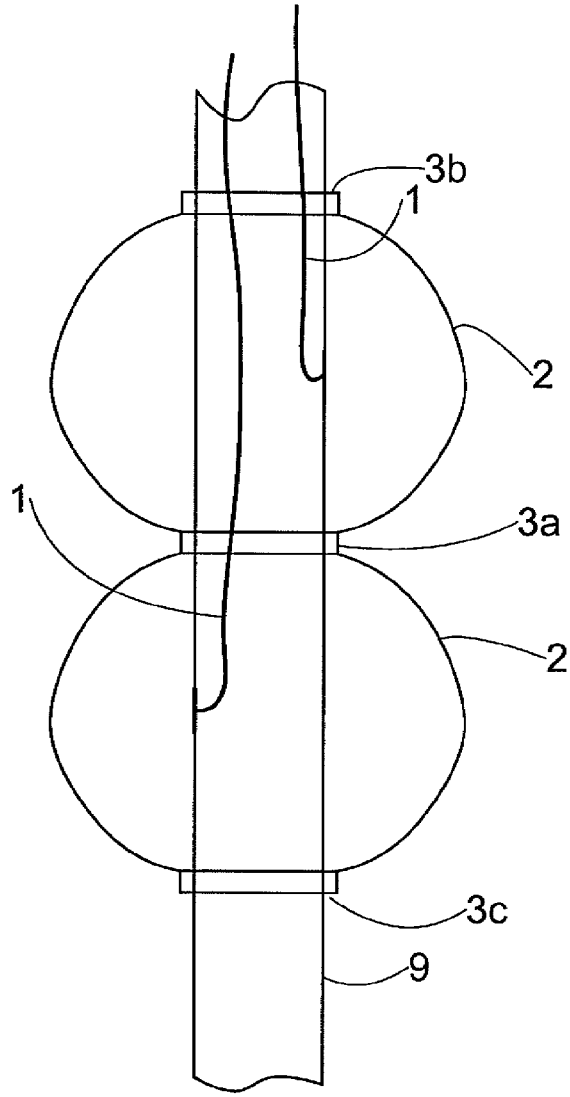

In the embodiment of FIG. 7, the expansion elements 2 are arranged outside a larger pipe 9. In the embodiment of FIG. 7, two expansion elements 2 have been arranged on top of one another and fastened by means of fasteners 3*a*, 3*b*, and 3*c*. Also in this embodiment, hoses serving as injection bars 1 are arranged inside the pipe 9 having a larger diameter.

Figure 8:
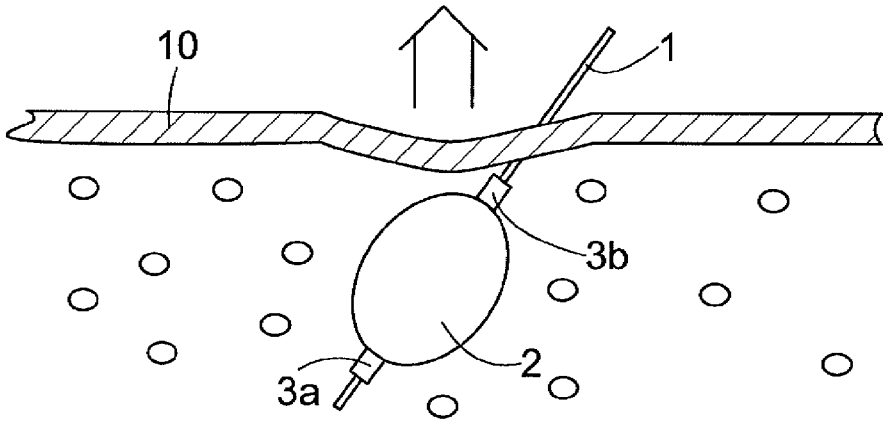

FIG. 8 shows a basic principle for lifting a ground-based structure 10. The amount to be injected during lifting may be determined by observing the vertical transition of the ground-based structure. Observing the vertical transition may mean observing when the structure starts moving, or observing when the structure has risen a desired distance. In FIG. 8, the ground-based structure 10 is designated by a road pavement. When lifting a ground-based structure, the expansion element is at least partly supported by the soil.

In some cases the features disclosed in the present application may be used as such, irrespective of other features. On the other hand, the features set forth in the present application may, when necessary, be combined in order to provide different combinations.

The drawings and the related description are only intended to illustrate the idea of the invention. In its details, the invention may vary within the scope of the claims.

In addition to improving soil, the disclosed solution may thus be used for lifting ground-based structures, whereby e.g. damaged, subsided or dislocated buildings or foundations or floors of structures are lifted and stabilized. Further, the solution may be used for lifting and stabilizing subsided paved roads, for instance. An empty space beneath a structure may necessitate a lifting process. In such a case, a hole may be drilled through the structure and arrange an injection bar therethrough such that an expansion element sets in the empty space. Next, the expansion element is filled as described above such that the chemical expansion reaction taking place inside the expansion element fills the empty space. The injection bar 1 may be arranged either directly downwards or obliquely downwards. Moreover, the injection bar 1 may also be arranged horizontally when processing e.g. the soil in embankments. The solution may also be used for lifting and fixing abutments or approaches for bridges.

Furthermore, the disclosed solution may be used for providing a dam wall to prevent water from passing in the soil or excavation. Similarly, the solution may be used for supporting walls of excavations. A dam wall or an excavation support may be provided by arranging expansion elements side by side. An expanding substance may be injected outside the expansion elements between the elements in order to attach the expansion elements to one another.

Preferably, the amount of a substance to be injected into an expansion element is thus determined prior to injecting, on the basis of soil characteristics, volume of the expansion element and the desired effect. The amount to be injected may also be determined by monitoring the expansion element being filled. Such monitoring may be carried out by means of e.g. an earth radar. In such a case, the material of the expansion element, for instance, may be selected such it can be seen in the radar. For example, the wall of the expansion element may be provided with metal fibers to make the expansion element clearly visible in the radar. Furthermore, the amount of the substance to be injected may be determined by monitoring the consistency of the soil or the density of the filling material. A further solution is to arrange a pressure sensor inside the expansion element or in the wall of the expansion element, inside or outside the wall. The pressure sensor may also be arranged in the soil, in the vicinity of the expansion element, i.e. outside the expansion element. Further, the size of the expansion element may be monitored by means of a thermographic camera.

The procedure of monitoring the expansion element being filled in order to determine the amount to be injected may also be carried out such that the substance is injected into the expansion element until the expansion element breaks as the substance expands without, however, the structure under repair being damaged. The breakage of the expansion element is observed on the basis of sound or shock. Before breaking, however, the expansion element 2 has restricted the substance to remain at a particular point. The substance hardens so quickly that even if the expansion element is broken, it does not creep a long distance away from the injection site, not even in soft soil.

Preferably, the wall of the expansion element is manufactured from an airtight material. In such a case, the expansion element may be oxygen-free. When the inside of the expansion element is oxygen-free, the reaction of the substance can be managed extremely well. On the other hand, no need exists for the expansion element to be completely oxygen-free on the inside. However, an oxygen-free wall ensures that substantially no oxygen enters the expansion element from outside. When the wall of the expansion element prevents additional oxygen supply, the expansion reaction of the substance can thus be kept under control.

No need necessarily exists for the wall of the expansion element to remain intact after the expansion reaction. At the beginning of the expansion reaction, however, the expansion element restricts the expanding substance to remain within the desired area, so that even in a porous soil, the substance does not start creeping. If the substance reacts, i.e. hardens, quickly enough, no uncontrollable creeping of the substance in the soil occurs even if the wall of the expansion element is broken.

The invention claimed is:

1. A method for condensing, filling or replacing soil and/or for lifting structures, the method comprising:

providing the soil or structure with a hole;

arranging into the hole an injection bar and an expansion element provided in connection therewith; and injecting a substance into the expansion element, whereby the substance expands as a consequence of a chemical reaction inside the expansion element, so that a force pressing the expansion element against the soil is generated mainly by the chemical reaction.

2. A method as claimed in claim 1, comprising determining characteristics of the soil prior to injecting and determining an amount of the substance to be injected into the expansion element prior to injecting on the basis of the characteristics of the soil, volume of the expansion element, and a desired effect.

3. A method as claimed in claim 1, comprising determining the amount of the substance to be injected into the expansion element by monitoring the expansion element being filled.

4. A method as claimed in claim 3, comprising monitoring the expansion element being filled by means of an earth radar.

5. A method as claimed in claim 3, comprising monitoring the expansion element being filled by means of a pressure sensor.

6. A method as claimed in claim 3, comprising monitoring the expansion element being filled by means of a thermographic camera.

7. A method as claimed in claim 3, comprising monitoring the expansion element being filled by means of the senses of hearing and/or feeling such that the process of injecting the substance into the expansion element is stopped after the expansion element has broken.

8. A method as claimed in claim 1, comprising determining the amount to be injected in connection with lifting a structure by means of observing any vertical transfer of the structure.

9. A method as claimed in claim 1, comprising leaving the injection bar in its place in connection with the expansion element after the substance has expanded.

10. A method as claimed in claim 1, comprising arranging the injection bar through the expansion element and by arranging the substance to flow into the expansion element via openings provided on a side of the injection bar.

11. A method as claimed in claim 10, wherein the injection bar comprises an outer pipe provided with openings, and an inner pipe arranged thereinside, the substance to be injected being fed along the inner pipe and the inner pipe being pulled out of the inside of the outer pipe when the substance is being injected.

12. A method as claimed in claim 1, comprising arranging the expansion reaction of the substance to take place inside the expansion element in an airtight space.

13. A method as claimed in claim 1, comprising arranging the substance to react after more than 25 seconds since being injected into the expansion element.

14. A method as claimed in claim 13, comprising arranging the substance to react after less than 50 seconds since being injected into the expansion element.

15. A method as claimed in claim 1, comprising arranging the substance to react after less than 50 seconds since being injected into the expansion element.

16. A method as claimed in claim 1, comprising arranging the substance to expand 1.5 to 20 times its original volume.

17. A method as claimed in claim 1, comprising determining, before injecting, a final compression strength of the substance to be injected.

18. A method as claimed in claim 17, comprising determining the final compression strength of the substance to be injected on the basis of the resistance of the soil and the volume of the expansion element.

19. A method as claimed in claim 1, comprising letting some of the substance to go through the wall of the expansion element.

20. An arrangement for condensing, filling or replacing soil and/or for lifting structures, the arrangement comprising:

an injection bar to be arranged into a hole and provided in connection with an expansion element;

a substance to be injected into the expansion element; and means for injecting the substance into the expansion element, wherein the substance to be injected into the expansion element is a substance which expands as a consequence of a chemical reaction inside the expansion element, so that a force pressing the expansion element against the soil is generated mainly by the chemical reaction, and further wherein the injection bar is drawn out of the expansion element after the substance is injected into the expansion element.

21. An arrangement as claimed in claim 20, wherein the injection bar is arranged through the expansion element, whereby the expansion element is at its lower end fastened to the injection bar by means of a lower fastener and at its upper end by means of an upper fastener, and that a side of the injection bar is provided with openings via which the substance is allowed to flow into the expansion element.

22. An arrangement as claimed in claim 21, wherein the lower fastener and/or the upper fastener are made movable in relation to the injection bar.

23. An arrangement as claimed in claim 21, wherein the injection bar comprises an outer pipe provided with openings, and an inner pipe arranged inside the outer pipe for feeding the substance to be injected inside the expansion element, the inner pipe being pullable out of the inside of the outer pipe.

24. An arrangement as claimed in claim 20, wherein the expansion element is manufactured from an airtight material.

25. An arrangement as claimed in claim 20, wherein the expanding substance is such that its expansion reaction starts after more than 25 seconds since being injected into the expansion element.

26. An arrangement as claimed in claim 20, wherein expanding substance is such that it expands 1.5 to 20 times its original volume.

27. A method for condensing, filling or replacing soil and/or for lifting structures, the method comprising:

providing the soil or structure with a hole;

arranging into the hole an injection bar and an expansion element provided in connection therewith;

injecting a substance into the expansion element, whereby the substance expands as a consequence of a chemical reaction inside the expansion element, so that a force pressing the expansion element against the soil is generated mainly by the chemical reaction;

determining, before injecting, a final compression strength of the substance to be injected; and determining the final compression strength of the substance to be injected on the basis of the resistance of the soil and the volume of the expansion element.

* * * * *